US006141814A

United States Patent [19]

Renken

[11] Patent Number: 6,141,814

[45] Date of Patent: Nov. 7, 2000

[54] SQUEEGEE HAVING SPONGE WASHER WITH REPLACEABLE MESH PROTECTOR APPARATUS

[76] Inventor: John C. Renken, 6815 Washington St., NE., Fridley, Minn. 55432

[21] Appl. No.: 09/399,073

[22] Filed: Sep. 18, 1999

Related U.S. Application Data

[63] Continuation-in-part of application No. 09/042,299, Mar. 13, 1998, Pat. No. 6,000,089.

[51] Int. Cl.[7] ..... A47L 1/15

[52] U.S. Cl. ..... 15/121; 15/118; 15/220.1; 15/244.3

[58] Field of Search ..... 15/121, 118, 210.1, 15/231, 232, 233, 244.1, 244.3, 245, 220.1

[56] References Cited

U.S. PATENT DOCUMENTS

| | | | |
|---|---|---|---|
| 1,644,642 | 10/1927 | Horihata | 15/231 |
| 1,847,046 | 2/1932 | Guerra | 15/231 |
| 2,601,537 | 6/1952 | Lofgren | 15/231 |
| 3,641,612 | 2/1972 | Clurman et al. | 15/231 |
| 3,724,017 | 4/1973 | Mallory | 15/121 |
| 3,783,469 | 1/1974 | Siemund | 15/121 |
| 4,106,153 | 8/1978 | Lemelson | 15/231 |
| 4,550,467 | 11/1985 | Johnson et al. | 15/233 |
| 5,448,793 | 9/1995 | Mallory et al. | 15/121 |
| 5,864,913 | 2/1999 | Robertson et al. | 15/121 |

*Primary Examiner*—Theresa T. Snider
*Attorney, Agent, or Firm*—Nawrocki, Rooney & Sivertson, P.A.

[57] ABSTRACT

The squeegee has a washing element which is attached to a support member and covered by a mesh protector. Replacement apparatus provides for rapid replacement of the mesh. The replacement apparatus includes a length of mesh wrapped around a reel. The wrapped end of the mesh is secured by locking the reel against rotation relative to the support member. The free end of the mesh is secured by mesh receiving projections positioned a top the support member which engage the free end of the mesh. To replace mesh which extends over the washer, the free and wrapped ends of the mesh are released and a length of mesh is pulled from the reel and stretched over the washer. Both ends of the mesh are then resecured to provide for a taut mesh deployment over the washer. The reel is removable to permit replacement with a new mesh supply. A cleaning disk for cleaning insects and similar difficult spots can be removably attached at one end of the squeegee. Reinforcing means is provided for stabilizing the support member relative to the handle receiver.

22 Claims, 9 Drawing Sheets

SQUEEGEE HAVING SPONGE WASHER WITH REPLACEABLE MESH PROTECTOR APPARATUS

CROSS REFERENCE TO RELATED APPLICATIONS

This application is a continuation-in-part of co-pending application Ser. No. 09/042,299, filed Mar. 13, 1998, now U.S. Pat. No. 6,000,089, for SQUEEGEE HAVING SPONGE WASHER WITH REPLACEABLE MESH PROTECTOR APPARATUS.

BACKGROUND OF THE INVENTION

1. Field of the Invention

This invention relates to improved window cleaning apparatus, in particular to a squeegee which includes a mechanism to readily replace mesh used to protect a washing element.

2. Description of the Prior Art

A number of squeegee type window cleaners are known in the art. Typically these squeegees have a handle attached to a support with a sponge washer attached to one side of the support. This arrangement permits using the handle readily to manipulate the sponge washer and remove dirt and insects from a window. Most squeegees also provide a wiper element opposite the sponge washer to facilitate removing water from a window. The wiper element is also manipulated by the handle. A squeegee type window cleaning apparatus which also uses mesh to protect a foam washing element is disclosed in Mallory, U.S. Pat. No. 5,448,793. Mallory describes and teaches the use of a washer protected by a mesh screen.

No apparatus known in the art, of which applicant is aware, provides means for readily replacing all of the working parts in a squeegee which becomes worn in normal usage. As a consequence, squeegee replacement is abnormally high because the entire squeegee must be replaced when only one of the working parts is damaged or worn.

SUMMARY OF THE INVENTION

Gasoline service stations usually provide a number of squeegees for customers to wash their vehicle's dirty windows. A squeegee typically has a support with a sponge washing element mounted on one side, a rubber flexible wiper mounted on the opposite side and a handle typically positioned at 90° to both. The handle extends from the support for manipulation. The sponge washer is usually covered with non-replaceable mesh to provide protection and extend the washer life. Since a squeegee is used by a great number of people, the mesh protector soon becomes torn and, with no protection, the washer can then become quickly damaged beyond use. Such squeegees do not have means for readily replacing the wearing parts, particularly the protecting mesh and washer. This usually results in the entire squeegee being discarded when any single part is excessively worn. Because of the great number of service stations providing squeegees, the cost of replacing them is high because of the great number used and ultimately discarded over time.

The present invention provides improvements to a squeegee which makes parts readily replaceable. Since the mesh is usually worn first, the present invention provides apparatus for enabling rapid and ready replacement of the mesh covering the washer. This is accomplished by providing a spooled length of mesh which is adequate to replace the mesh covering the washer a number of times. This length of mesh is wound on a reel with extending hubs. In one embodiment, the hubs extend into holes in flexible supporting extensions depending from the support body, and mount the reel for rotation. The extensions are located such as to position the reel near the handle and proximate the washer with the mesh oriented parallel to the surface of the extending washer surface. This permits mesh to be pulled from the reel around and over the exposed washer surface to the support surface opposite the handle. A removable locking pin, which extends through holes in the reel and opposed aligned holes around the circumference of the enclosing extension, can lock the reel against rotation. Thus, the wrapped end of the mesh is anchored. The extensions are flexible enough to permit an end of the reel to be pulled free in order to permit replacing an empty mesh reel with a new reel wound with a new supply of mesh.

After pulling the mesh over the washer from the reel, the opposite free end of the mesh is stretched tight over the washer and then secured in place. In one embodiment, the locking means for the free end of the mesh employs a recess in a surface of the support. That locking means also uses a plastic locking strip which has a serrated edge along its length. The mesh is stretched across the recess, and the serrated edge of the locking strip is placed perpendicular to the mesh with the serrated edge extending through the mesh. The mesh and locking strip are then forced into the recess. This arrangement secures the free end of the mesh in place with the mesh stretched tightly around the washer.

This process is repeated until all of the mesh on a reel has been used. The locking pin can then be removed from the reel, the free end of the mesh released, and the reel removed by springing at least one of the extensions outward. A new reel with a new length of mesh is then put into place, and the mesh is reattached over the washer as described above.

In an alternate embodiment, the free end of the mesh advanced from the spooled supply of mesh is reliably secured in place about the washer by a plurality of spaced apart mesh receiving projections extending from the support member. The mesh is preferably deployed about the washer in a taut condition. Towards this end, means are provided for fixed positional holding of the spooled or reeled supply of mesh relative to the reel supports.

Also envisioned is an alternative embodiment wherein fixed positional holding of the reel is accomplished by providing knobs or cones which extend radially outwardly from a surface of at least one of a pair of reel supports, the knobs or cones cooperating with corresponding receivers or dimples formed in a corresponding hub. While not an exclusive configuration, one embodiment envisions the employment of three knobs or cones, spaced from one another at approximately 90°, extending radially inwardly from the inner surface of a reel support. The reel support is generally "C-shaped" to capture a hub therewithin.

In yet another embodiment of this squeegee invention, lid, reinforcing means are provided for stabilizing the support member relative to the handle receiver. This is particularly expedient when window washing requires additional washing or scrubbing force, as may be the case for the removal of insects, mud, etc. from the window.

All parts of the squeegee are similarly configured for ready replacement. In addition to the usual squeegee parts a cleaner disk can be attached near one end of the washer by use of a bolt through a hole in the disk center and into a mating threaded hole in the support. This cleaner disk can be used to remove insects or similar material.

DESCRIPTION OF THE DRAWINGS

Objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE INVENTION

Figure 1:
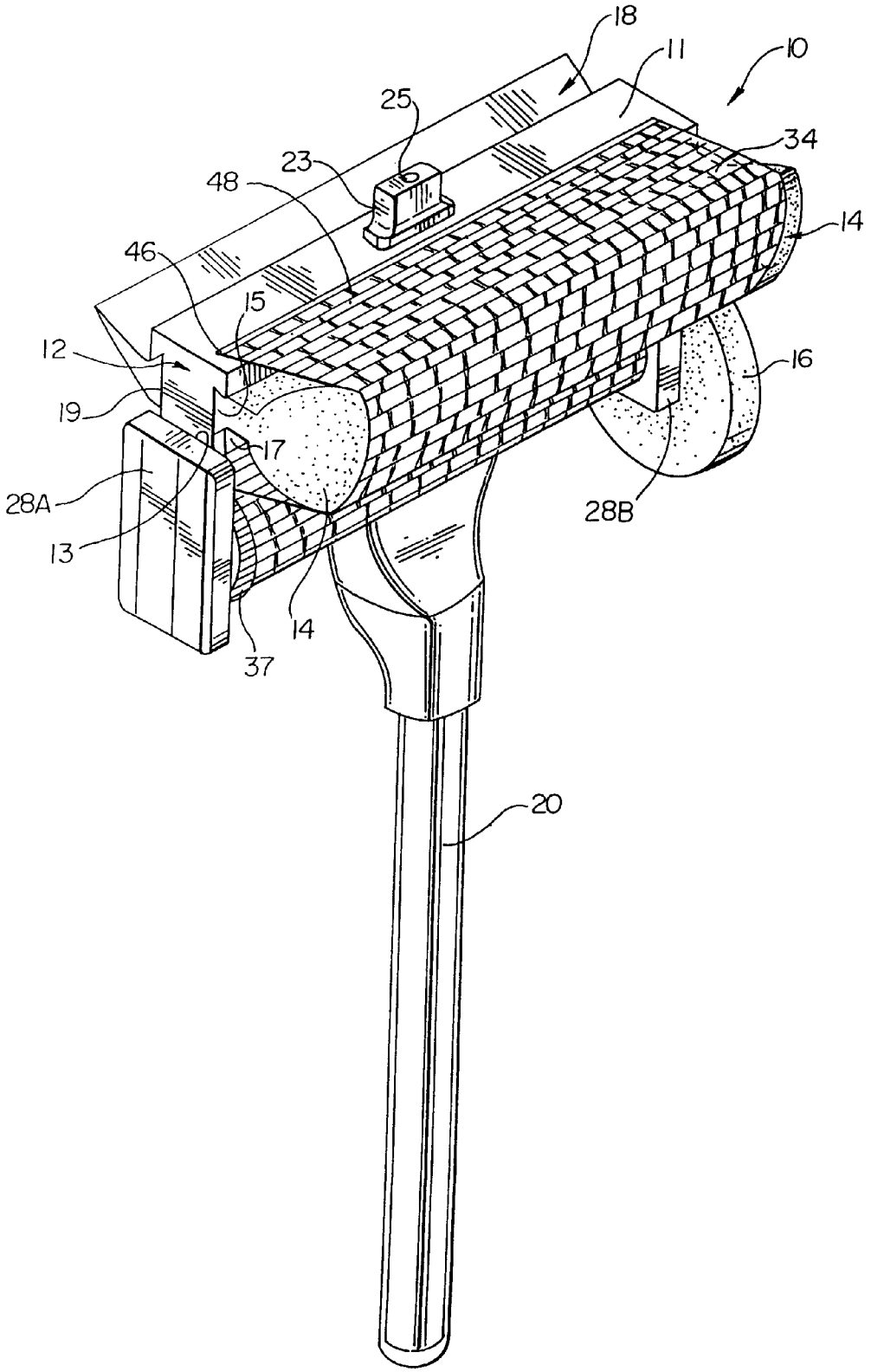
FIG. 1 is a perspective view of a squeegee in accordance with the present invention.
Figure 2:
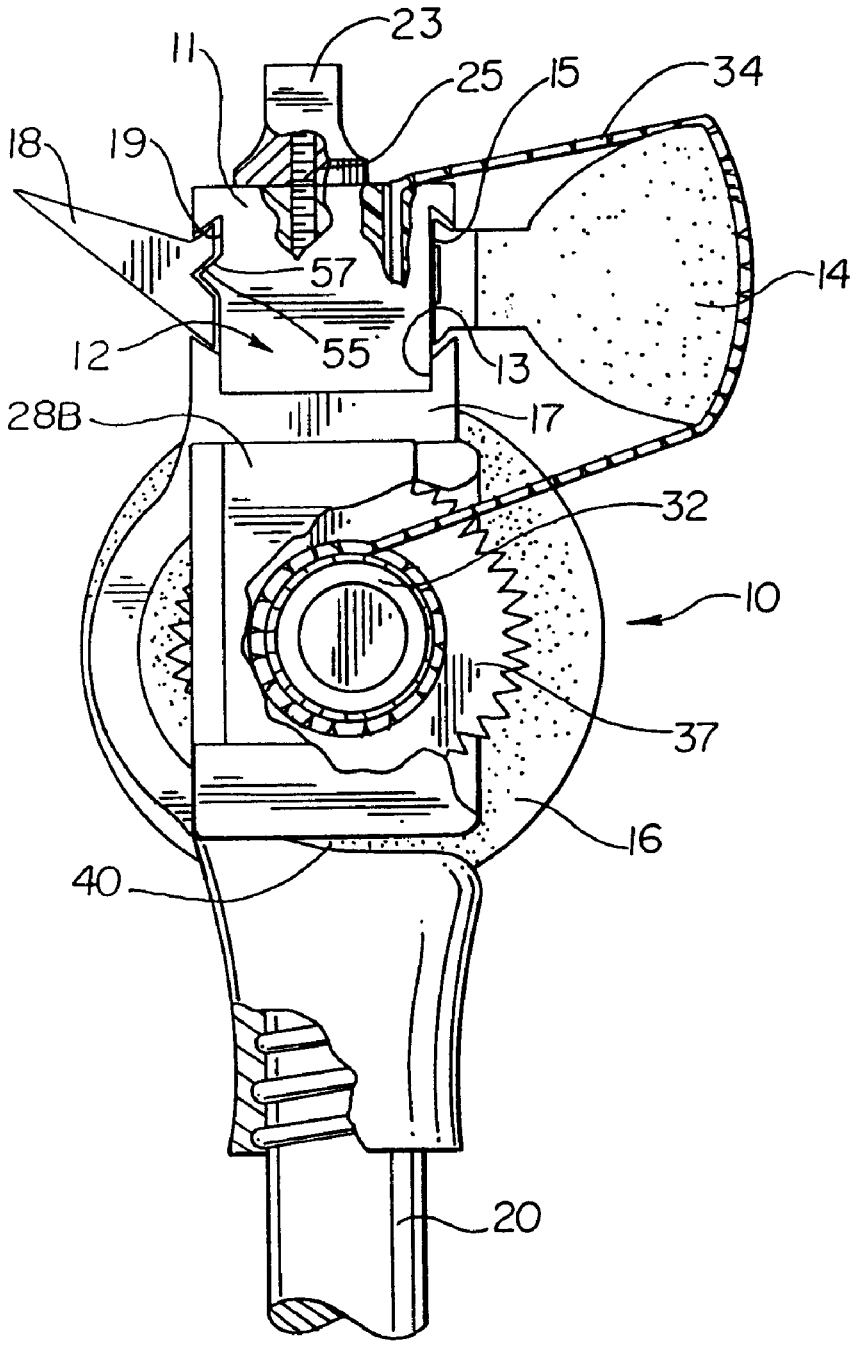
FIG. 2 is an end view of the squeegee of FIG. 1.
Figure 3:
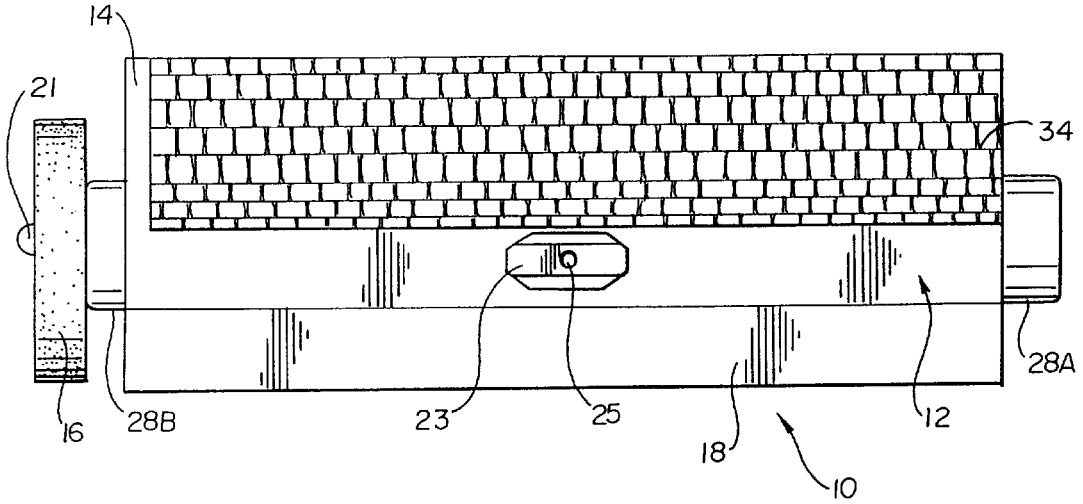
FIG. 3 is a top plan view of the squeegee of FIG. 1.

FIGS. 1, 2, 3 and 4 show a squeegee 10 having support 12, sponge washer 14, cleaner disk 16 (which can be made of cellulose or other appropriate material), flexible wiper 18 and handle 20. Washer 14 and wiper 18 are each secured within respective opposed recesses 15 and 19 defined in support 12 by mating a carrier portion 11 into a recess 13 formed in a base portion 17. This permits replacing washer 14 and/or wiper 18 by loosening a locking nut 23 and merely sliding the washer 14 and/or wiper 18 laterally from their respective recesses 15 and 19 defined in support 12 until they are free of the support 12. FIG. 2 illustrates a wiper 18 having a keyway 55 formed in an edge thereof which engages a side face of carrier portion 11 of support 12. That face of carrier portion 11, in turn, can be provided with a key 57 positioned at a location on the face of the carrier portion 11 so that, when the key 57 is received within keyway 55, wiper 18 will be positioned at an appropriate location so that, as nut 23 is tightened down, wiper 18 will be captured within recess 19 defined in support 12 by mating carrier portion 11 with base portion 17. It will be understood that, while a similar configuration is not illustrated in the figures with respect to washer 14, in appropriate circumstances where a base of the washer 14 might be rigid, a similar key/keyway arrangement might be utilized.

Cleaner disk 16 is shown as being mounted to one of a pair of support extensions 28A, 28B, and it carries elongated threaded member 21 which is to be received within a threaded hole in an extension 28B. Member 21 allows securing the cleaner disk 16 in place yet enables ready removal.

Figure 4:
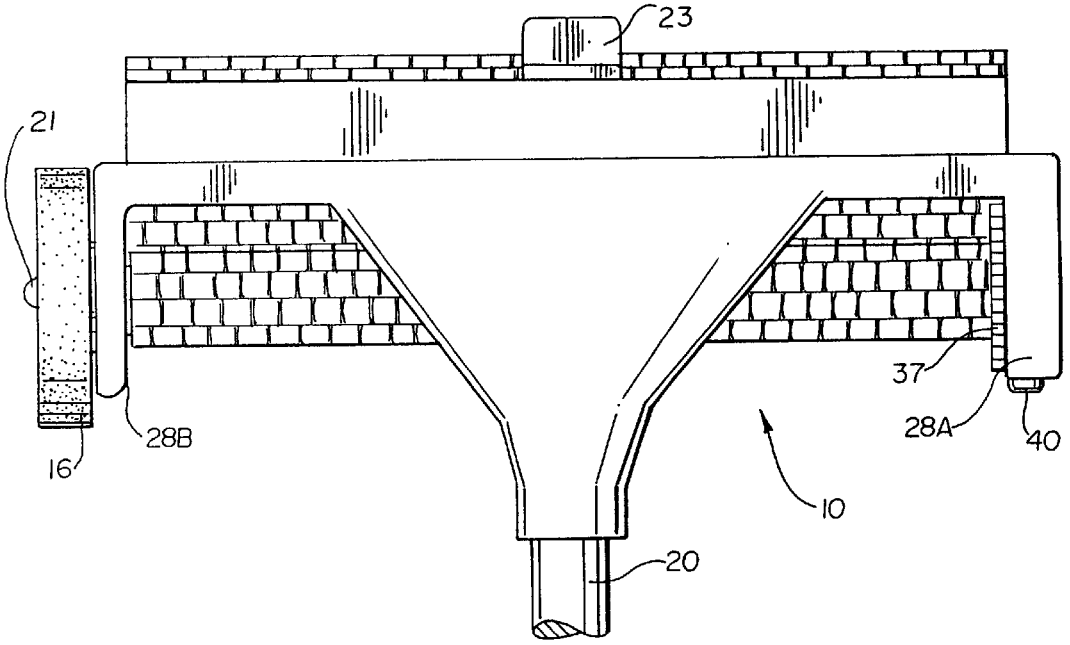
FIG. 4 is a side view of the squeegee of FIG. 1 from the side opposite the washer.
Figure 4A:
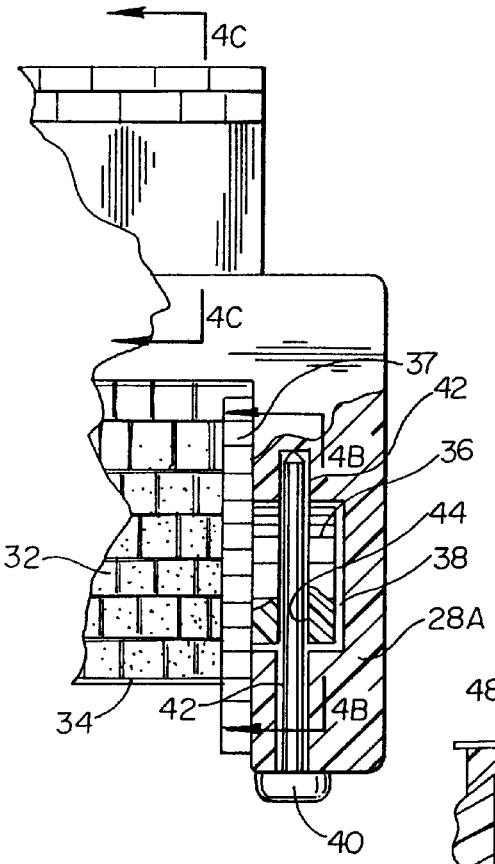
FIG. 4A is the end portion of FIG. 4 with a portion of the support extension removed to show the mesh reel hub, locking pin and the locking pin access holes.

Reel 32 has axially extending hubs 36, as best seen in FIG. 4A, which are rotatably journaled within mating holes in extensions 28A and 28B depending from support 12. Reel 32 has one or more rotation disks 37 attached at one end for simultaneous rotation. Reel 32 is rigidly secured to disks 37 and to hubs 36, and rotation of disks 37 translates into rotation of reel 32.

One end of a length of mesh 34 is wrapped around reel 32 and the opposite end is secured, after passing over washer 14, to support 12 by a plastic locking strip 48, the operation of which will be described later. The axis of reel 32 is parallel to the outer surface of washer 14. This permits mesh 34 to be pulled from the reel 32 and around and over the outer surface of the washer 14 to a recess 46, which would typically be tapered, formed in carrier portion 11 of support 12.

Figure 4C:
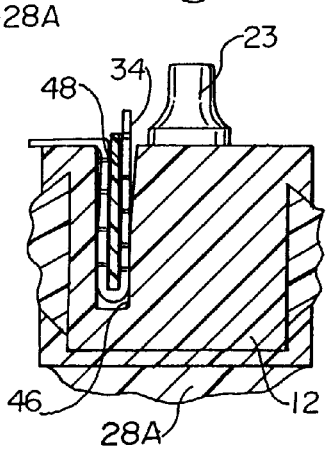
FIG. 4C is a cross-section of 4C—4C of FIG. 4A showing the serrated mesh locking strip and its interaction with the support.
Figure 4B:
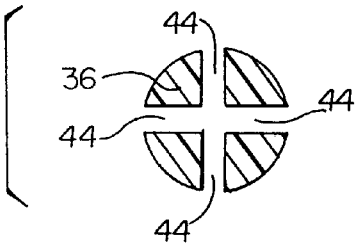
FIG. 4B is a cross-section of 4B—4B of FIG. 4A showing the pin access holes through the hub.

FIGS. 4A and 4B show details of locking means for reel 32. One hub 36 is received within a corresponding mating hole 38 in extension 28A which rotatably supports the hub 36. The opposite end of reel 32 has a hub which is received within a corresponding mating hole in extension 28B which rotatably supports the opposite end of the reel. The hubs 36 and respective extensions 28A and 28B are symmetrical except that extension 28B and its hub have no locking access holes as described below relative to extension 28A.

Extensions 28A and 28B are both flexible and extend outwardly from support 12 and generally parallel to one another. This permits flexing extensions 28A and 28B outwardly to clear hubs 36 to free the reel from capture in a position between extensions 28A, 28B. This allows replacement of the reel 32 to replenish the mesh supply.

The means for securing the mesh 34 tautly over washer 14 with one end of mesh 34 wrapped around reel 32 is shown in detail in FIGS. 4A and 4B. Aligned access holes 42 through extension 28A on diametrically opposite sides of hub 36 are sized to slideably receive locking pin 40. Pin 40 has a cap on its outermost end larger than access holes 42. Perpendicular locking holes 44 through hub 36, which are approximately the same size as access last holes 42, are positioned so as to enable registration with access holes 42 when reel 32 is rotated 90° by disks 37. This permits extending locking pin 40 through the outer access hole 42, through an aligned locking hole 44 in hub 36 and into the inner aligned access hole 42 to lock reel 32 against rotation. To unlock reel 32, locking pin 40 is merely withdrawn from holes 42 and 44.

Figure 5:
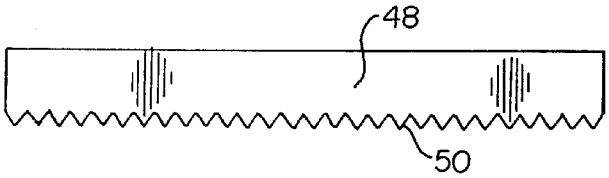
FIG. 5 is a view of the serrated mesh locking strip of the embodiment of FIG. 1.

The means for securing the end of mesh 34 remote from reel 32 is shown in detail in FIGS. 4C and 5. Plastic mesh locking strip 48 is sized to fit snugly within recess 46 extending across support 12. Recess 46 can be tapered for this purpose. The plastic strip 48 has a serrated edge 50, strip 48 being inserted into recess 46 with the serrated edge 50 extending downward such that points of the serrated edge 50 engage mesh 34 to secure the free end of the mesh in place. Plastic strip 48 holds the free end of mesh 34 securely in place but can provide a quick release by merely pulling on the mesh 34 to remove the strip 48 from recess 46.

Bolt 25 has its distal, threaded end (not shown) securely captured within an aperture in support portion 17 with the threaded end of the bolt extending through and outwardly from a mating hole generally centered on the support 12. Nut 23 functions to tightly secure carrier portion 11 to base portion 17. This serves to well-define recesses 15 and 19 and to reinforce the support 12.

Figure 6:
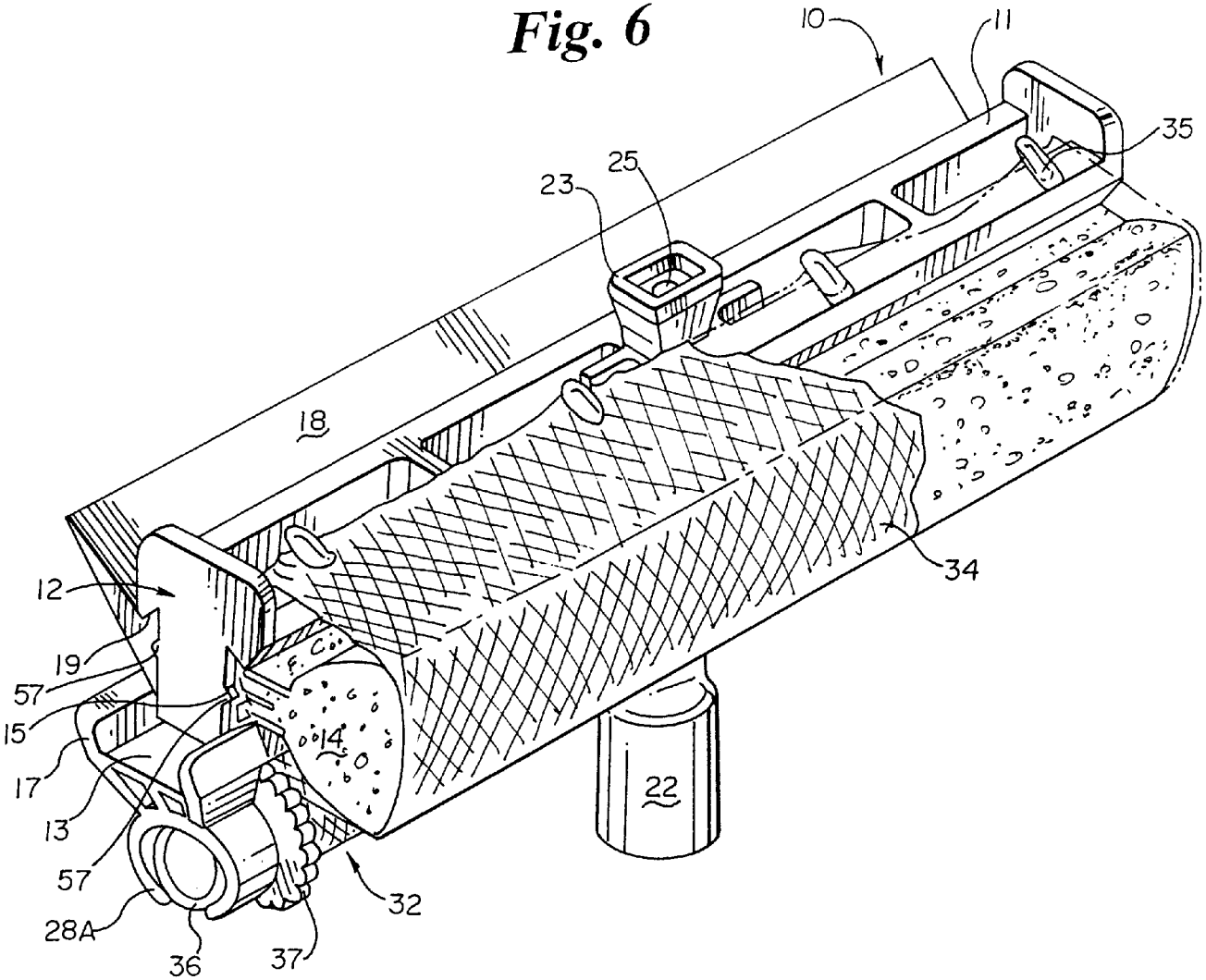
FIG. 6 is a perspective view of an alternate embodiment of a squeegee in accordance with the present invention.
Figure 7:
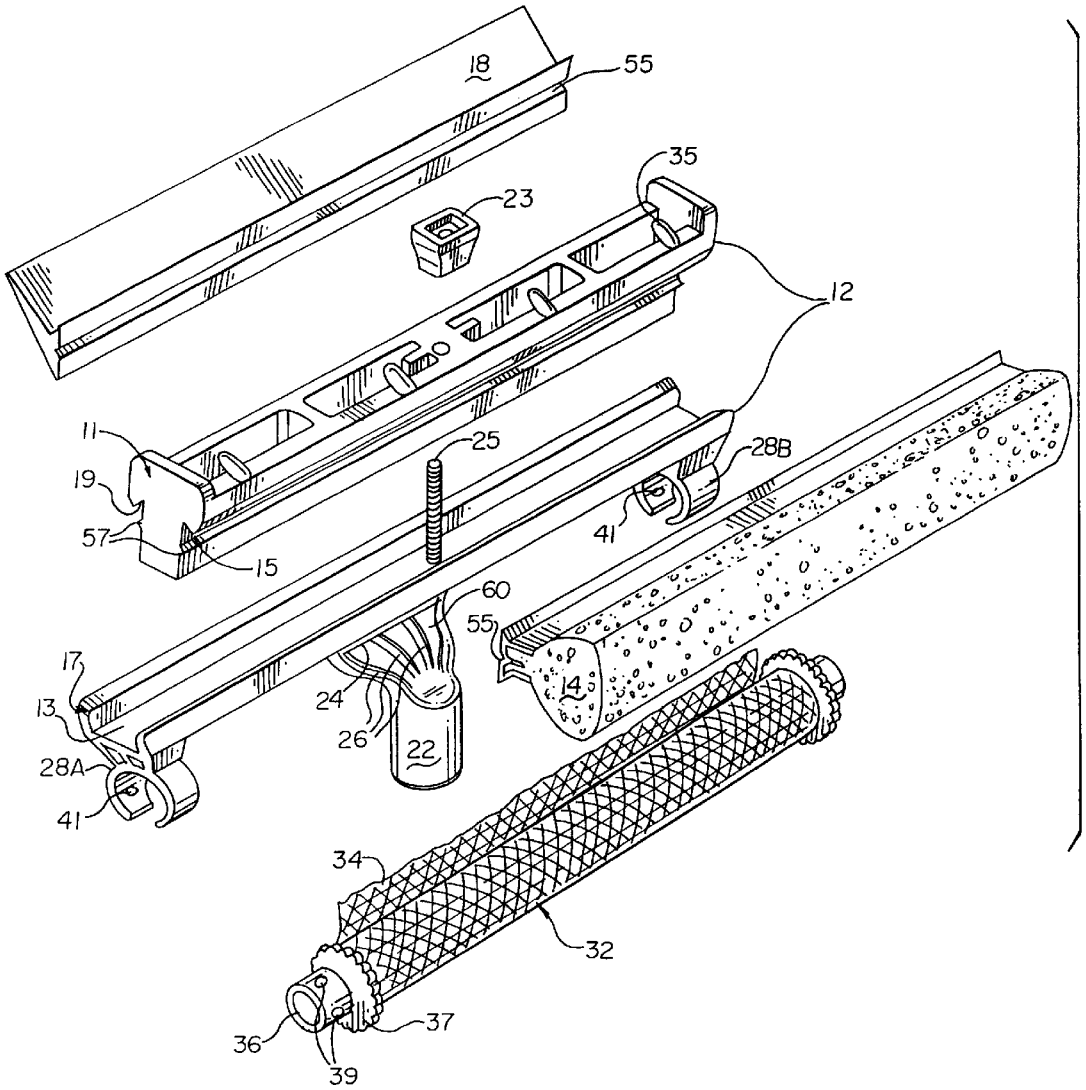
FIG. 7 is an exploded view of the squeegee of FIG. 6.

In the alternate embodiment of FIGS. 6 & 7, squeegee 10 has elongated support member 12 equipped with washing element 14, flexible wiper 18 and a reeled or spooled supply of mesh 32. Washer 14 and wiper 18 are each secured within respective opposed recesses 15 and 19 defined in support member 12 by mating a carrier portion 11 into a recess 13 formed in base portion 17 of support member 12. This permits replacing washer 14 and/or wiper 18 by loosening locking nut 23 and merely sliding washing element 14 and/or wiper 19 laterally from their respective recesses 15 and 19 until they are free of the support 12. Both the washing element 14 and the wiper 18 preferably have keyways 55 formed in an edge thereof which engage a side face of carrier portion 11. The side face of carrier portion 11 is equipped with corresponding keys 57 positioned to be received in keyways 55 of either or both of the replaceable washing 14 and wiping 18 elements, such that as nut 23 is tightened down on bolt 25, wiper 18 and washing element 14 will be captured within recesses 19 and 15 respectively of support member 12 by mating carrier 11 with base portion 17.

Reel 32 has axially extending hubs 36 which are engagingly bracketed by a pair of reel supports 28A and 28B depending generally from support member 12. The reel supports 28A and 28B rotatably support the reel 32 at axially extending hubs 36 so to position reel 32 adjacent to washing element 14, with the rotational axis of reel 32 substantially parallel to the length of washing element 14. This permits the free end of mesh 34 to be suitably and efficiently positioned for easy deployment about washing element 14. The extending reel supports 28A and 28B are preferably flexible enough to permit easy removal of "spent" reels and insertion of replacement mesh reels, as the need arises. The profile of supports 28A and 28B, somewhat resembling the letter "C", facilitates flexing and quick insertion and/or removal of reels.

The free end of mesh 34 from reel 32 is reliably secured or anchored to support member 12 after passing over washer 14. Carrier 11 of support member 12 is equipped with a plurality of spaced apart mesh receiving projections 35 for holding the free end of mesh 34. The mesh receiving projections 35 are finger like extensions of carrier 11 and are positioned opposite handle receiver 22 (i.e., at the top of support member 12) which is offset to accommodate optimal alignment of reel 32 with support member 12. Preferably projections 35 are directed away from washer 14 (i.e., generally point towards wiper 18) to better fasten and anchor the free end of mesh 34 to support member 12, but may be otherwise positioned and/or configured so as to reliably secure the free end of mesh 34.

Means are provided for fixed positional holding of reel 32 relative to reel supports 28A and 28B to thereby provide a tensioned deployment of mesh 34 about washer 14. As shown in FIG. 7, knobs or cones 41, spaced angularly about an inner surface of a reel support, cooperate with angularly spaced knob receivers 39 (i.e., matching depressions for seating the knobs) formed in hubs 36 of reel 32. As discussed above, knob receivers 39 are preferably carried by hubs 36, while the knobs or cones 41 are preferably positioned on reel supports 28A and 28B, specifically on the semi-circular inside surface thereof. Up to four knob receivers are positioned on the surface of the hub 36 to cooperatively engage up to three knobs positioned on the inside surface of the "C" shaped reel supports 28A and 28B such that reel 32 is for all practical purposes held in a fixed, semi-locked position relative to support member 12. Adjustment or change of the fixed reel position so as to advance and deploy mesh 34 from reel 32 is accomplished by rotation of single or dual rotation disks 37 on reel 32. The ability to hold reel 32 in a fixed or static position relative to support member 12 via cooperating knobs 41 and knob receivers 39 permits metered advancement of mesh 34 from the reeled supply of mesh and taut deployment of the mesh 34 about washer 14 via anchoring of the free end of mesh 34 at mesh retaining projections 35.

Reel 32 can have a generally cylindrical cavity passing therethrough. Alternatively, opposite axial ends of reel 32 can have cavities therein while a center portion of the reel 32 might be obstructed. In either case, the open, recessed end of reel 32 can serve as a receptacle for a mounting boss (not shown) of an attachment such as cleaner disk 16. When such a construction and operation of components is used, the boss would typically be friction-fitted into the cavity in order to be held in place.

Figure 8:
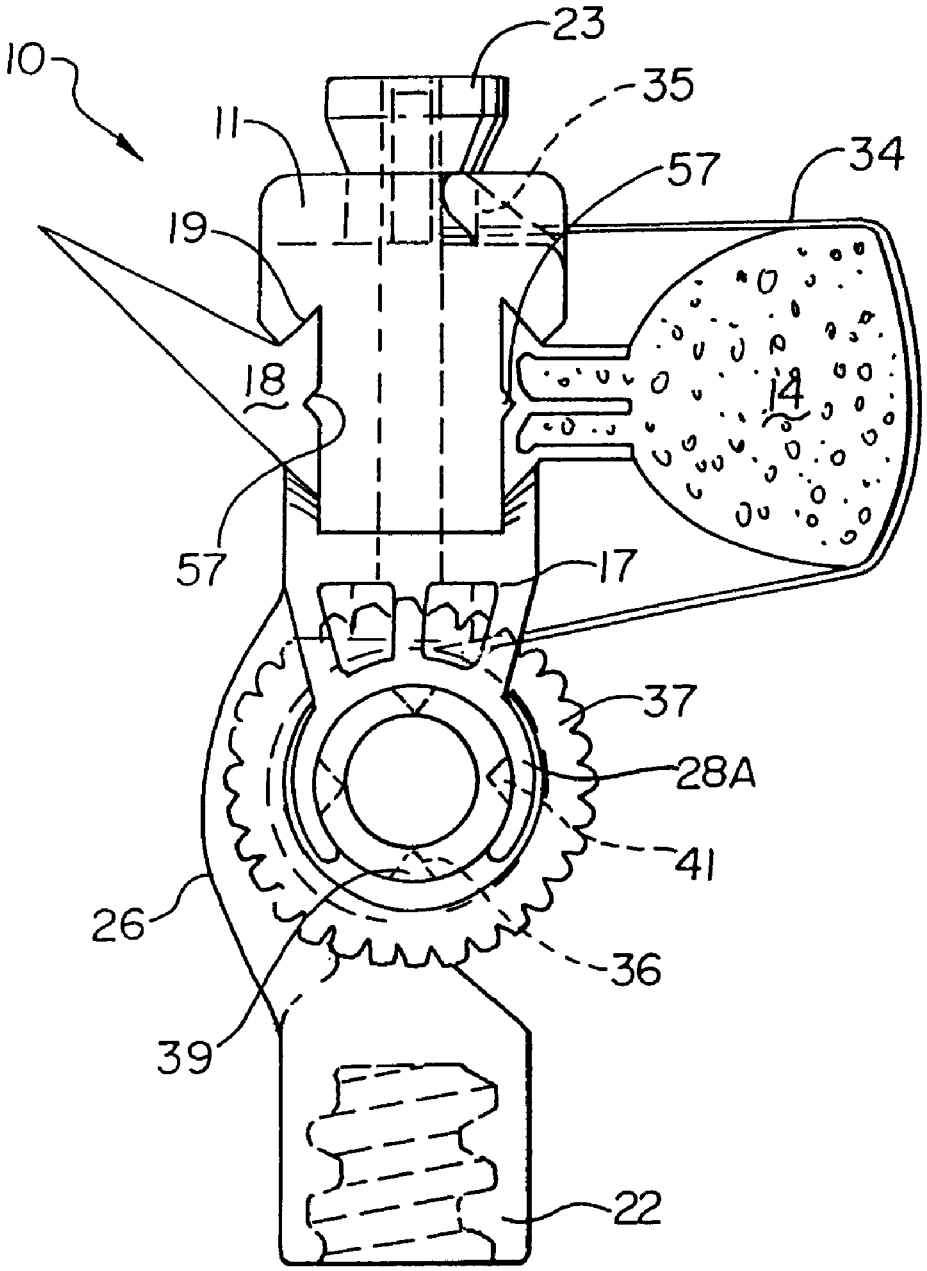
FIG. 8 is a side view of yet an another embodiment of the squeegee depicting stabilizers for the support member.
Figure 9:
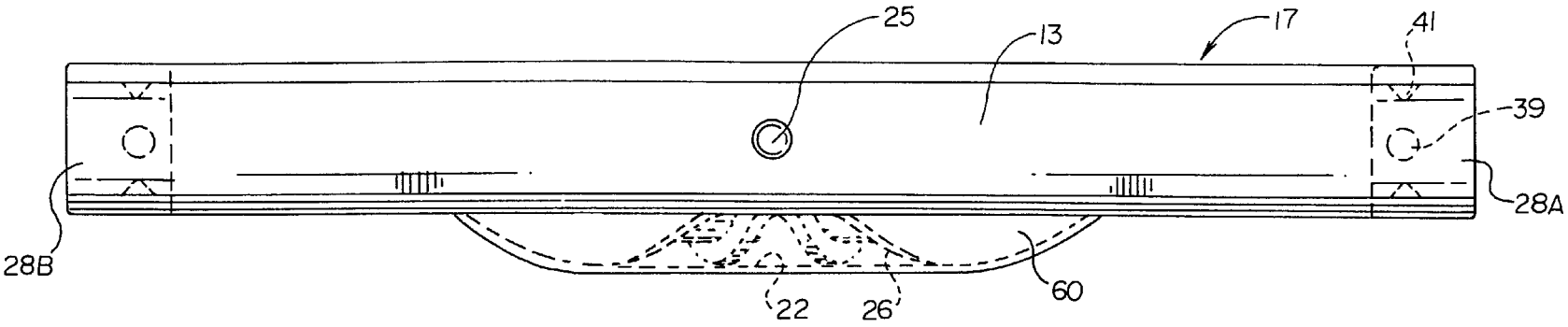
FIG. 9 is a top view of the squeegee of FIG. 8 with the carrier, wiper and washer removed to show underlying detail; and, FIG. 10 is front view of the squeegee of FIG. 8.
Figure 10:
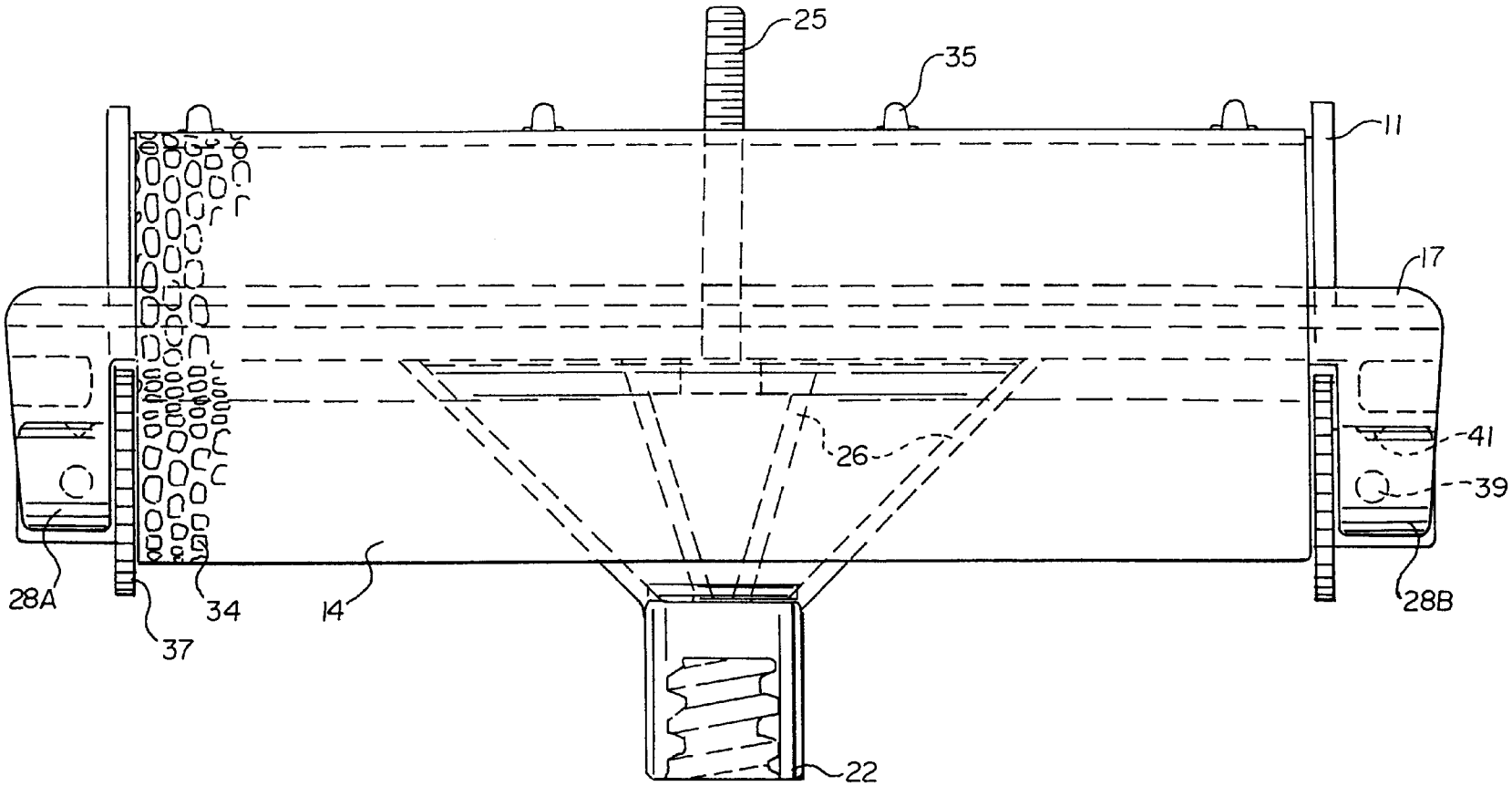

As shown in FIGS. 8, 9 and 10, squeegee 10 further includes reinforcing means for stabilizing elongated support member 12 relative to handle receiver 22. Stabilization of support member 12 relative to handle receiver 22 via reinforcement is particularly advantageous, permitting reliable squeegee use when extra washing or scrubbing force is required as is often times the case when difficult to remove items are present on the window.

Preferably, reinforcing ribs 26 extend from the handle receiver 22 and terminate at spaced apart intervals along the length of the elongated support member 12. The ribs 26 are symmetrically paired about a centerline extending through bolt 25 and handle receiver 22 and are configured to permit unencumbered rotation of reel 32 on reel supports 28A and 28B, as well as unhindered egress and ingress of reel 32 from supports 28A and 28B during times of reel replacement. Reinforcement of support member 12 relative to handle receiver 22 may also be suitably accomplished by other means, such as providing a greater longitudinal contact interface 24 between handle receiver 22 and support member 12, as is best seen in FIG. 7.

Ribs 26 are preferably formed on the inner side of a cowl 60 which wraps around a portion of the backside of reel 32. While base portion 17 of support 12 protects the upper side of reel 32, cowl 60 serves to protect the backside and a part of the underside of reel 32. As one will be able to see in view of this disclosure, washer 14, in view of its forwardly extending disposition, serves to protect the front side of reel 32. Consequently, reel 32 will be protected around virtually 360° so that damage which might result because of heavy use will not be occasioned upon reel 32.

Making all parts of the squeegee subject to wear readily replaceable in the manner described in the present invention greatly reduces the cost of use. Rather than replacing the entire squeegee when a worn mesh results in a worn washer or when other parts become worn, with the present invention only the part which is worn need be replaced. Since all parts are easily replaceable, the replacement process itself is cost effective. Because squeegees are used by a public indifferent to their destruction, a great number of squeegees are quickly damaged and presently must be replaced. The present invention permits a quick and easy replacement of only the worn part. This results in a considerable cost savings to the operator. These improvements essentially extend the squeegee life.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. A window cleaning apparatus, comprising:

an elongated support member having a handle receiver and a plurality of spaced apart mesh receiving projections positioned opposite said handle receiver, said elongated support member being equipped with opposing washing and wiping elements;

a predetermined length of mesh having a width approximately the length of said washing element;

a rotatable reel having a rotational axis and axially extending hubs spaced along said rotational axis, one end of said length of mesh being wrapped about said rotatable reel so as to form a reeled supply of mesh, said mesh being advancable therefrom;

a pair of reel supports depending from said elongated support member to capture respective hubs of said reel and thereby rotatably support said reel adjacent said washing element with said rotational axis of said reel substantially parallel to said length of said washing element; and means for holding said reel against rotation relative to said reel supports to thereby permit tensioned deployment of said mesh about said washing element when said mesh is hooked upon said receiving projections.

2. The window cleaning apparatus of claim 1 wherein said means for holding of said reel against rotation relative to said reel supports includes cooperating knobs and knob receivers, said knobs carried by said reel supports and said knob receivers carried by said hubs.

3. The window cleaning apparatus of claim 2 further comprising means for rotating positional adjustment of said rotatable reel, and wherein said means for rotating positional adjustment of said rotatable reel comprises at least one adjustment wheel.

4. The window cleaning apparatus of claim 3 further comprising reinforcing means for stabilizing said support member relative to said handle receiver.

5. The window cleaning apparatus of claim 4 wherein said reinforcing means includes ribs extending from said handle receiver and terminating at spaced apart intervals along the elongation of said elongated support member.

6. The window cleaning apparatus of claim 4 further including a scrubbing element for removing difficult-to-remove adherents from a window, and including means for attaching said scrubbing element to said support member.

7. The window cleaning apparatus of claim 4 further including a scrubbing element for removing difficult-to-remove adherents from a window, and including means for attaching said scrubbing element to one of said hubs of said rotatable reel so as to extend outwardly beyond one of said reel supports.

8. A window cleaning apparatus comprising:

a support assembly having base and carrier portions, said base portion having a handle receiver, said carrier portion mating with said base portion to thereby form opposing washing and wiping element recesses which has washing and wiping elements secured therein;

reinforcing means for stabilizing said support assembly relative to said handle receiver;

a predetermined length of mesh having a width generally equal to the length of said washing element;

a rotatable reel having a rotational axis, axially extending hubs along said rotational axis and means for rotational positional adjustment of said rotatable reel, one end of said length of mesh being wrapped about said rotatable reel so as to form a reeled supply of mesh, said mesh being advanceable therefrom;

a pair of reel supports depending from said base portion of said support assembly to engagingly bracket said hubs of said reel therebetween and thereby rotatably support said reel adjacent to said washing element with said rotational axis of said reel substantially parallel to said length of said washing element; and means for fixed positional holding of said reel relative to said reel supports to thereby permit tensioned deployment of said mesh about said washing element.

9. The window cleaning apparatus of claim 8 further comprising a plurality of spaced apart mesh receiving projections positioned along the top of said carrier portion of said support assembly.

10. The window cleaning apparatus of claim 9 wherein said means for positional holding of said reel relative to said reel supports includes cooperating knobs and knob receivers, said knobs carried by said reel supports and said knob receivers carried by said hubs.

11. The window cleaning apparatus of claim 10 wherein said means for rotating positional adjustment of said rotatable reel comprises at least one adjustment wheel.

12. The window cleaning apparatus of claim 11 wherein said reinforcing means includes ribs extending from said handle receiver and terminating at spaced apart intervals along the length of said base portion of said support assembly.

13. The window cleaning apparatus of claim 12 further including a scrubbing element for removing difficult-to-remove adherents from a window, and including means for attaching said scrubbing element to said support assembly.

14. The window cleaning apparatus of claim 8 further including a scrubbing element for removing difficult-to-remove adherents from a window, and including means for attaching said scrubbing element to one of said hubs of said rotatable reel so as to extend outwardly beyond one of said reel supports.

15. A window cleaning apparatus, comprising:

an elongated support member carrying opposing washing and wiping elements;

a reeled supply of mesh suspended from said elongated support member, said mesh being selectively advanceable from a reel of said reeled supply of mesh so as to be tautly deployed about said washing element;

a cowl depending, at an upper edge thereof, from said elongated support member, said cowl having a handle receiver proximate a lower edge thereof, said cowl extending angularly about at least 90 degrees of said reel; and means for selectively advancing said mesh from said reeled supply of mesh.

16. The window cleaning apparatus of claim 15 wherein said elongated support member includes base and carrier portions, said washing and wiping elements being mounted therebetween.

17. The window cleaning apparatus of claim 16 wherein a top portion of said reeled supply of mesh is protected by said base portion of said elongated support member.

18. The window cleaning apparatus of claim 16 further comprising means for strengthening said cowl including reinforcing ribs formed thereon.

19. The window cleaning apparatus of claim 18 wherein said reinforcing ribs extend substantially from said handle receiver to said base portion of said elongated support member.

20. The window cleaning apparatus of claim 19 wherein said reinforcing ribs are symmetrically paired about a centerline extending through said handle receiver.

21. The window cleaning apparatus of claim 15 wherein bottom and rearward portions of said reeled supply of mesh is protected by said cowl.

22. The window cleaning apparatus of claim 15 wherein a forward portion of said reeled supply of mesh is protected by said washing element.

* * * * *